US005312727A

United States Patent [19]

Yagi et al.

[11] Patent Number: 5,312,727

[45] Date of Patent: May 17, 1994

[54] SILVER HALIDE PHOTOGRAPHIC LIGHT-SENSITIVE MATERIAL HAVING A HIGH SENSITIVITY AND CAPABLE OF FORMING AN IMAGE WITH AN EXCELLENT QUALITY AND GRADATION

[75] Inventors: Toshihiko Yagi; Hiroyuki Hoshino; Toshiya Kondou; Katsuhiko Suzuki, all of Tokyo, Japan

[73] Assignee: Konica Corporation, Tokyo, Japan

[21] Appl. No.: 13,654

[22] Filed: Feb. 3, 1993

Related U.S. Application Data

[63] Continuation of Ser. No. 602,355, Oct. 22, 1990, abandoned.

[30] Foreign Application Priority Data

Oct. 27, 1989 [JP] Japan ..... 1-281446

[51] Int. Cl.[5] ..... G03C 1/005

[52] U.S. Cl. ..... 430/567; 430/569

[58] Field of Search ..... 430/567, 569

[56] References Cited

U.S. PATENT DOCUMENTS

| | | | |
|---|---|---|---|
| 3,885,970 | 5/1975 | Miyahara | 430/567 |
| 4,728,602 | 3/1988 | Shibahara et al. | 430/567 |
| 4,853,322 | 8/1989 | Makino et al. | 430/567 |

FOREIGN PATENT DOCUMENTS

| | | |
|---|---|---|
| 202784 | 11/1986 | European Pat. Off. . |
| 264954 | 4/1988 | European Pat. Off. . |
| 273411 | 7/1988 | European Pat. Off. . |
| 299719 | 1/1989 | European Pat. Off. . |
| 309119 | 3/1989 | European Pat. Off. . |

OTHER PUBLICATIONS

Patent Abstracts of Japan vol. 13 No. 108 (P-843) [3456]; Mar. 15, 1989 JPA-63-285,534.

*Primary Examiner*—Thorl Chea
*Attorney, Agent, or Firm*—Jordan B. Bierman

[57] ABSTRACT

There is disclosed a silver halide photographic light-sensitive material having an excellent interimage effect and gradation property. The light-sensitive comprises at least one light-sensitive layer containing silver bromoiodide emulsion consisting primarily of the twinned grains, wherein in an X-ray diffraction diagram which is obtained by subjecting the silver bromoiodide grains to a (420) X-ray diffraction with a CuK$\alpha$ ray, an intercept between the intersection points of a maximum peak diagram and a line drawn horizontally at a point of 0.13 times the height of the maximum peak corresponds to not less than 1.5 degree of a diffraction angle ($2\theta$).

37 Claims, 5 Drawing Sheets

(Em-1)

(Em-2)

(Em-3)

(Em-A)

(Em - B)

SILVER HALIDE PHOTOGRAPHIC LIGHT-SENSITIVE MATERIAL HAVING A HIGH SENSITIVITY AND CAPABLE OF FORMING AN IMAGE WITH AN EXCELLENT QUALITY AND GRADATION

This application is a continuation of application Ser. No. 07/602355, filed Oct. 22, 1990, now abandoned.

FIELD OF THE INVENTION

The present invention relates to a silver halide photographic light-sensitive material, and more particularly to a silver halide color photographic light-sensitive material having excellent interimage effect and gradation.

There has lately been increasing a demand for a silver halide photographic light-sensitive material having a high sensitivity and capable of forming a high-quality image.

To meet such demand, a number of techniques have been proposed to develop high-sensitive photographic emulsions comprising, particularly silver iodobromide. The techniques are centralized in improving the internal structures of silver halide crystals: Japanese Patent Publication Open to Public Inspection (hereinafter referred to as Japanese Patent O.P.I. Publication) Nos. 138538/1985, 143331/1985, 14636/1986, 112142/1986 and 20944/1987 disclose core/shell-type Silver iodobromide emulsions having a high silver iodide-content phases in the internals of the grains and low silver iodide-content phases in the outermost shells of the grains.

Although the above techniques contribute to increasing a sensitivity and improving a graininess of a light-sensitive material, when these emulsions are applied to a color negative light-sensitive material, they accelerate development so much as to make it difficult to control the development especially in the toe of a sensitometry curve by a development inhibitor-releasing compound (DIR compound), so that an interimage effect gets weaker and the sharpness and color reproducibility are not sufficiently improved. In addition, there is involved a problem that it is difficult to obtain a linearity of a gradation. Further, there exist the problems that a notably accelerated development is liable to cause a color stain due to diffusion of an oxidation product of a developing agent into adjacent layers and that graininess is deteriorated due to diffusion of the oxidation product from a high-sensitive layer to a low-sensitive layer.

To solve the above problems, there is disclosed the technique in Japanese Patent O.P.I. publication No. 232544/1985, in which a DIR compound having a large specific inhibiting effect is used. However, there are other problems in using such DIR compounds that the components for a light-sensitive material are limited and that the DIR compounds do not necessarily provide sufficient improvement.

Japanese Patent O.P.I. Publication No. 86659/1985 discloses a multilayered core/shell silver halide grains having a plurality of shells. This technique, however, has a problem that developing is so slow that the emulsion is too largely desensitized by a DIR compound to make it difficult to control a gradation.

SUMMARY OF THE INVENTION

It is an object of the present invention to provide a silver halide color photographic light-sensitive material having a high sensitivity, an excellent color reproducibility and a good gradation characteristic.

The above object is accomplished by a silver halide photographic light-sensitive material comprising a support and provided thereon component layers including at least one light-sensitive layer containing silver bromoiodide emulsion consisting primarily of twinned grains, wherein in an X-ray diffraction diagram which is obtained by subjecting the silver bromoiodide grains to a (420) X-ray diffraction with a CuKα ray, an intercept between the intersection points of a maximum peak diagram and a line drawn horizontally at the point of 0.13 times the height of the maximum peak corresponds to not less than 1.5 degree of a diffraction angle (2θ).

DETAILED DESCRIPTION OF THE INVENTION

Figure 1:
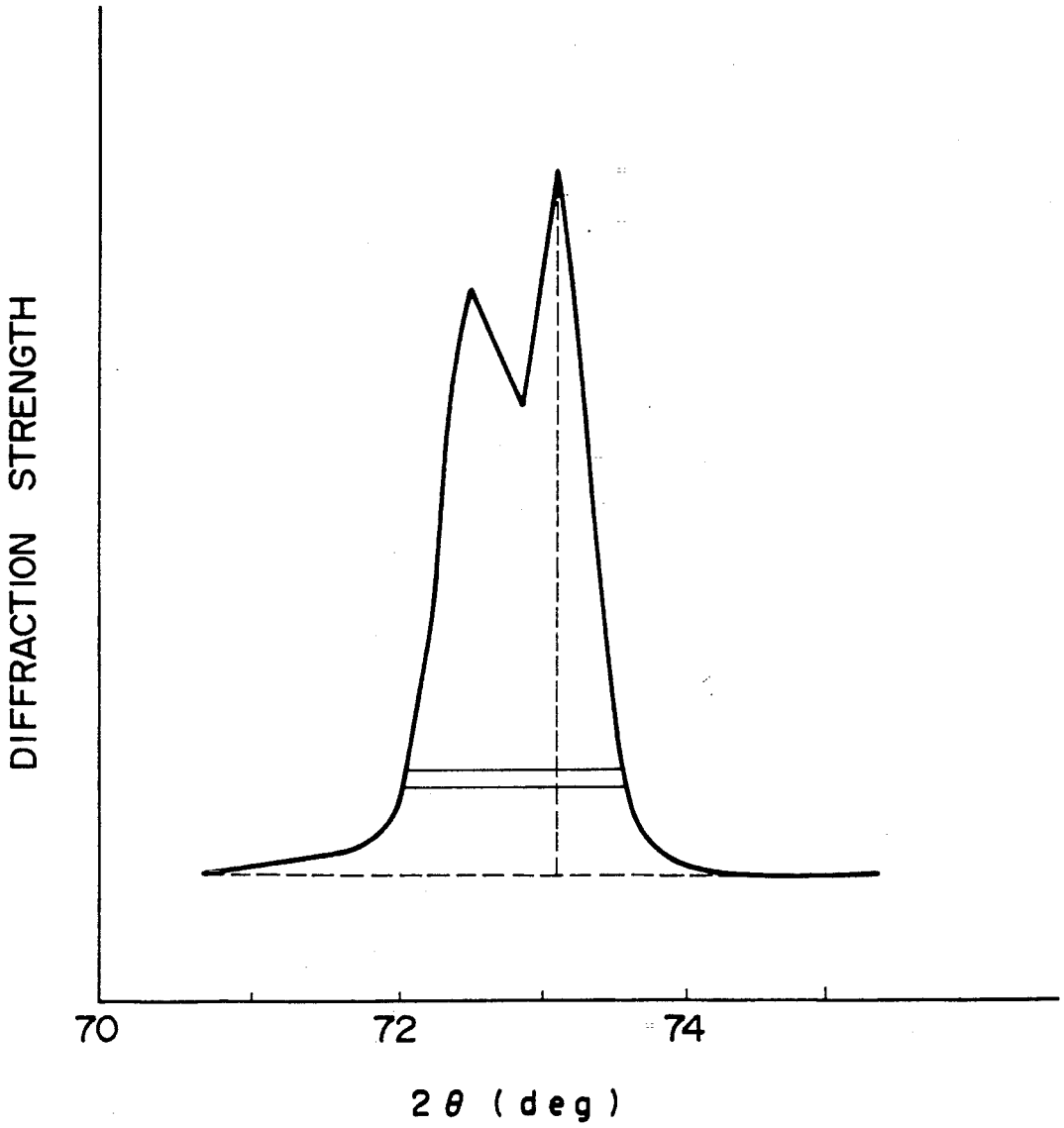
FIGS. 1 to 5 are graphs showing (420) X-ray diffraction patterns of Em-1, 2 and 3 of the invention and Em-A and B of the comparison.
Figure 2:
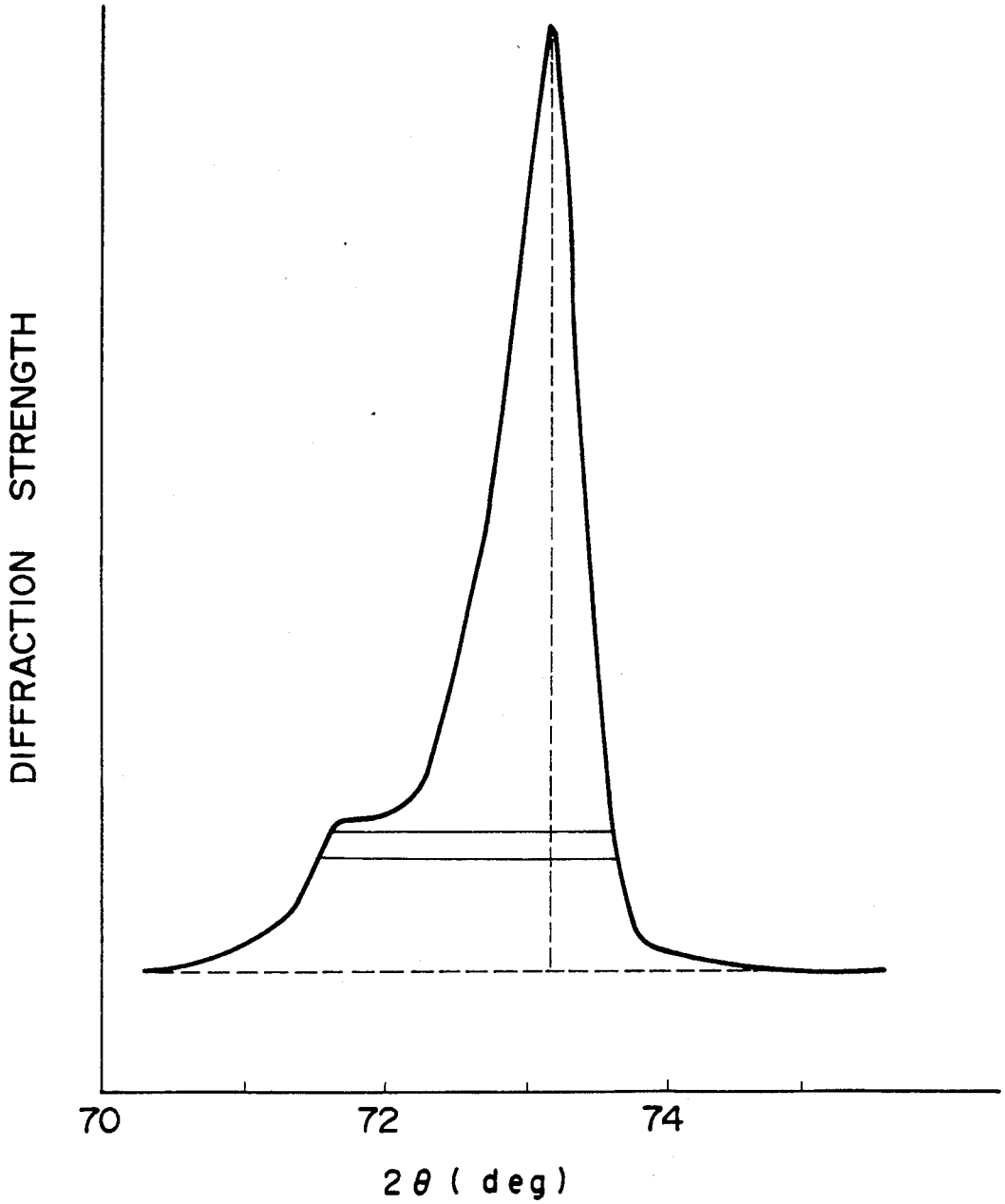
Figure 3:
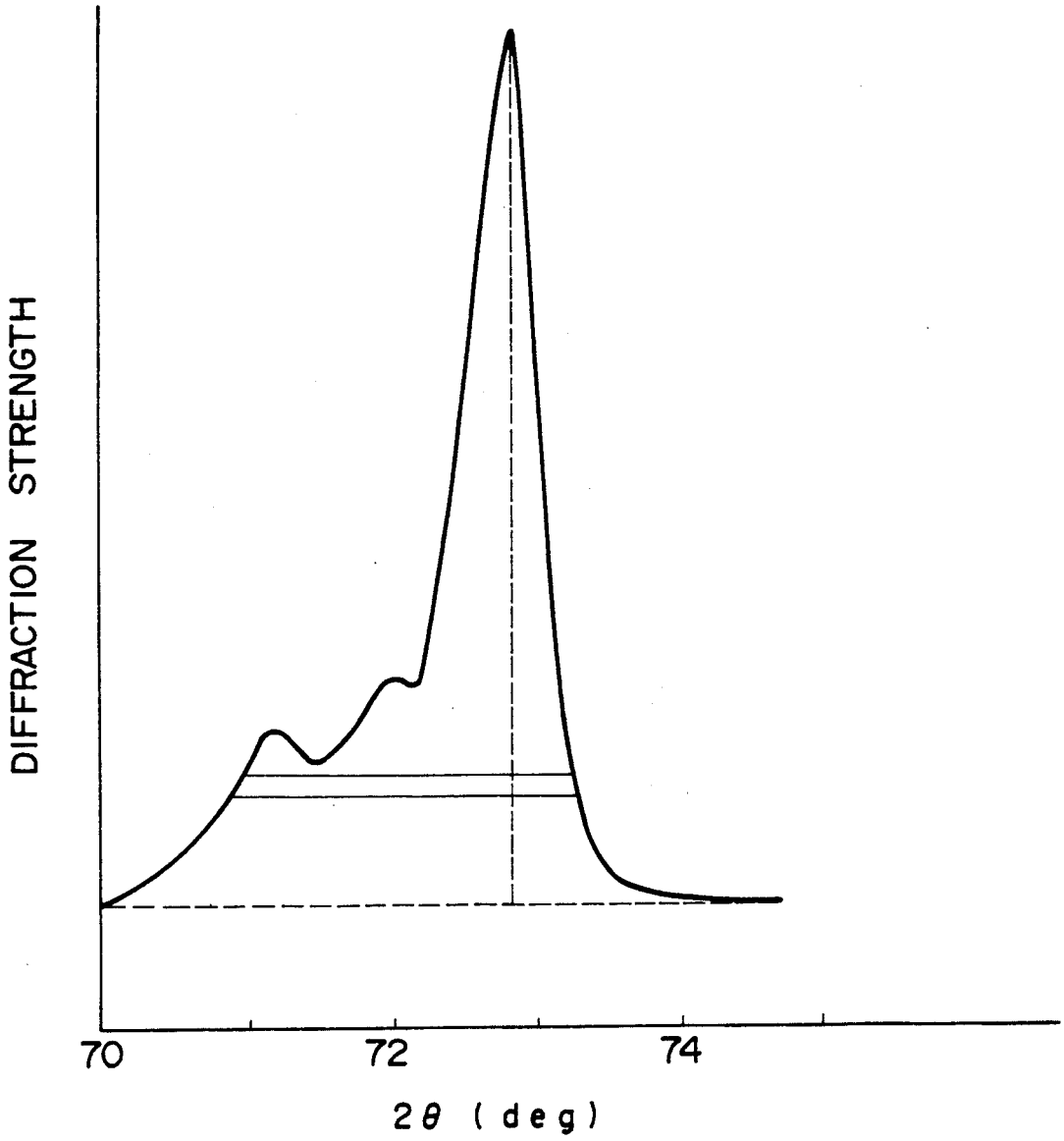
Figure 4:
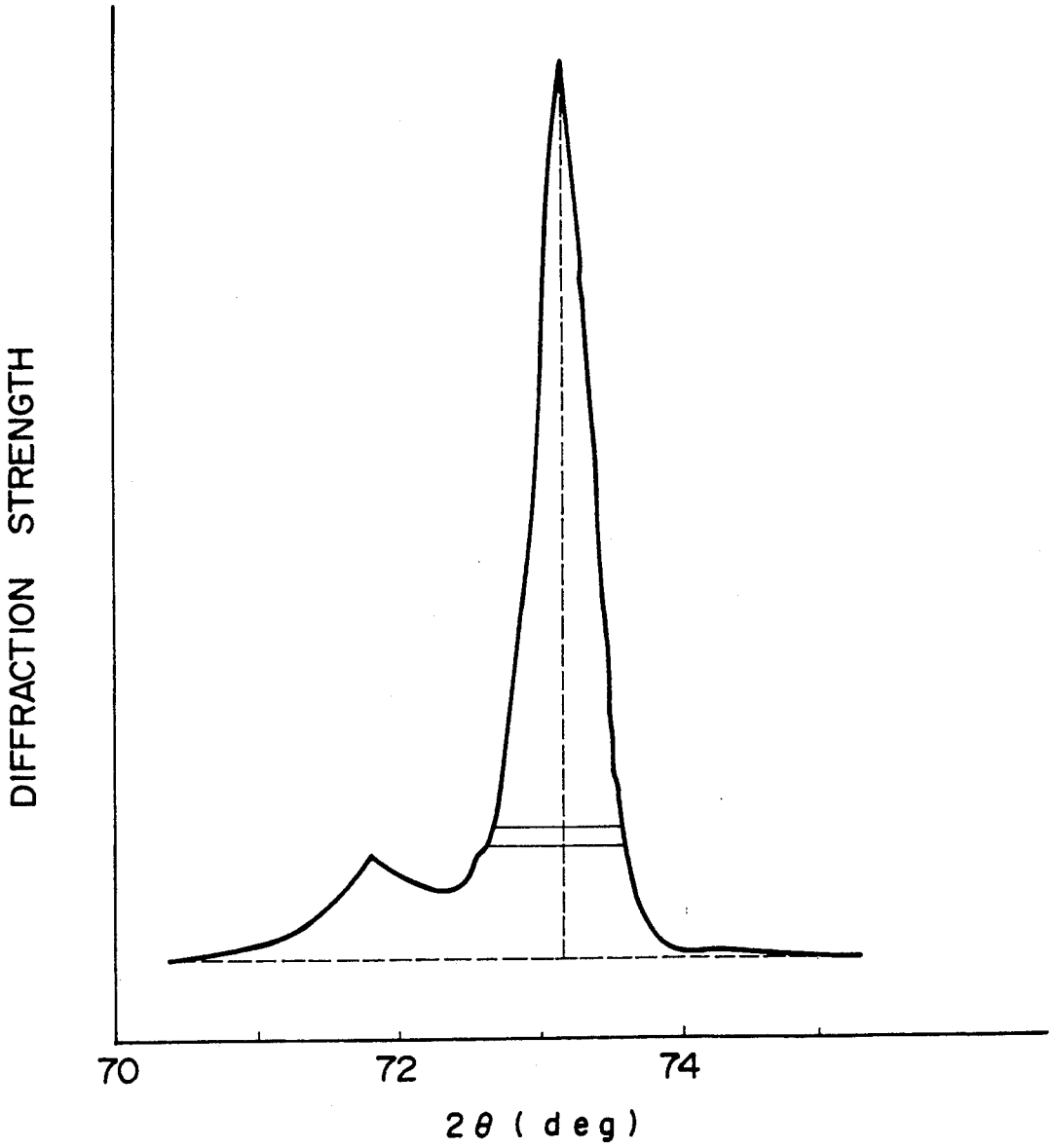
Figure 5:
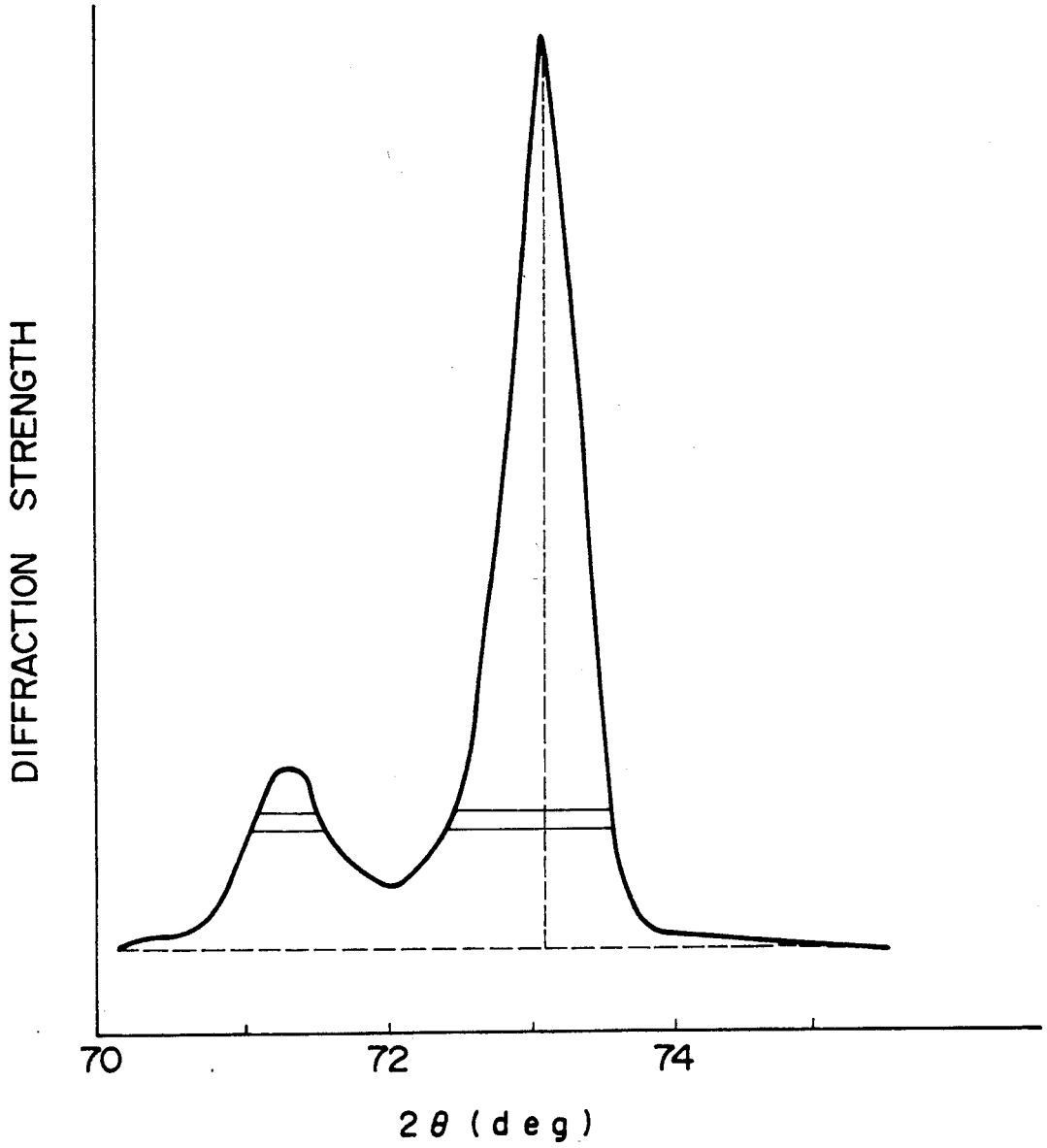

The silver halide grains of the invention comprise preferably two or more twinned planes, more preferably an even number of twinned planes, and further more preferably two twinned planes.

The two or more twinned planes may be or may not be parallel.

The grains having two or more parallel twinned planes account for 50% or more, preferably 60% or more, and more preferably 70% or more by number of the whole grains.

The twinned grains of the invention may consist of {111} planes, {100} planes or a combination thereof, preferably {111} planes.

In the grains having two or more parallel twinned planes, an aspect ratio of a diameter of a circle having the same area as that of the grain projected perpendicularly to the twinned planes to a distance (thickness) between the two grain surfaces parallel to the twinned planes is preferably 1 to 20, more preferably 1.2 to 8, and further more preferably 1.5 to 5.0.

In the invention, the twinned grains account for 60% or more, preferably 80% or more, and more preferably 95 to 100% by number of the whole grains.

The silver iodobromide emulsion comprising mainly twinned grains is preferably monodispersed.

The monodispersed silver halide grains of which grain size distribution is in the range of the average grain diameter $\bar{d}\pm20\%$ account for not less than 70%, preferably not less tan 80%, and more preferably not less than 90% by weight of the whole silver halide.

The average grain diameter d is defined by the grain diameter $d_i$ in which the product $n_i x d_i^3$ is maximized, wherein $n_i$ is the number of the grains having a diameter $d_i$ (significant figure is calculated down to the third decimal place and the fourth digit is rounded to the nearest whole number).

A grain diameter is defined by a diameter of a circle having the same area as that of the projected grain.

The grain diameter can be determined by measurement of the diameter of a grain image photographed via an electron microscope or projected at a magnifying ratio of 10,000 to 50,000 times (1,000 or more grains are sampled at random for the measurement).

The monodispersed emulsion of the invention has a grain diameter distribution of not more than 20%, and preferably not more than 15%, provided that the grain diameter distribution is defined by the following equation:

$$\frac{\text{Grain diameter standard deviation}}{\text{Average grain diameter}} \times 100 = \text{distribution width (\%)}$$

wherein the grain diameter is measured in accordance with the above method, and the average grain diameter is a simple mean value calculated by the following equation:

$$\text{Average grain diameter} = \frac{d_i n_i}{n_i}$$

An X-ray diffraction method is a known method for identifying a structure of a silver halide crystal.

Various X-ray radiation sources can be used. Among them, a CuK $\alpha$ ray wherein Cu is used as a target are most widely used.

Silver iodobromide has a rock salt structure, of which (420) X-ray diffraction diagram with a CuK$\alpha$ ray is in the diffraction angle (20) range of 71° to 74°.

The silver iodobromide emulsion of the invention consisting of twinned grains is characterized by the intercept corresponding to not less than 1.5 degrees, preferably not less than 1.8 degrees, more preferably 2.0 degrees of the diffraction angle ($2\theta$). wherein the intercept exists between the intersection points of the maximum peak diagram and the line drawn horizontally at the point of 0.13 times the height of the maximum peak.

At the point of 0.15 times of the maximum peak height, the above intercept corresponds preferably to not less than 1.5 degrees, more preferably not less than 1.8 degrees, further more preferably not less than 2.0 degrees of the diffraction angle ($2\theta$).

The above diffraction diagram has preferably a single peak. Another preferable embodiment of the invention is that the above diffraction diagram has at least three peaks, preferably three peaks.

In this embodiment, the diffraction diagram has preferably a single intercept at the point of 0.13 times the maximum peak height.

An average silver iodide content of the silver halide emulsion of the invention is preferably 6 to 30 mole %, more preferably 7 to 20 mole %, and further more preferably 8 to 15 mole %.

The silver halide emulsion of the invention may contain silver chloride.

The silver halide grains of the invention contain iodide localized in the grains in such a preferred embodiment that the grains comprise a core, an intermediate shell and the outermost shell in viewing from direction vertical to the broadest plane, each of which has a different iodide content.

The silver iodide content of the core is preferably 18 to 45 mole %, and more preferably 25 to 40 mole %. That of the intermediate shell is preferably 10 to 22 mole %, and more preferably 12 to 20 mole %. That of the outermost shell is preferably not more than 6 mole %, and more preferably 0 to 4 mole %.

The difference in the silver iodide content between the outermost shell and intermediate shell and between the intermediate shell and the core is preferably 6 mole % or more, and more preferably 10 mole % or more.

Further, a different other silver halide phase may be present in the central portion of the core, between the core and the intermediate shell and between the intermediate and outermost shells.

The outermost shell accounts for preferably 4 to 70%, and more preferably 10 to 50% by volume of the whole grain. The shell having a high silver iodide content accounts for preferably 10 to 80%, more preferably 20 to 50% and further more preferably 20 to 45% by volume. The intermediate shell accounts for preferably 5 to 60%, and more preferably 20 to 55% by volume.

The above shells may comprise a single shell of a uniform composition, a group of plural shells each having a uniform composition in which each composition changes stepwise, the shells in which the composition changes continuously, or a combination thereof.

The core and the intermediate and the outermost shells each may comprise silver iodobromide of a uniform or not uniform composition.

The silver iodobromide grains of which X-ray diffraction diagram has the foregoing intercept corresponding to not less than 1.5 degree of the diffraction angle ($2\theta$) at the point of 0.13 times the maximum peak height and has a single peak comprise preferably the shells each having an uneven composition. The silver iodobromide grains of which X-ray diffraction diagram has three or more peaks comprise preferably the shells each having a uniform composition.

Another embodiment of the invention is the silver bromoiodide grains having the iodide contents changing continuously from the core to the outermost shell, wherein it is preferable that the silver iodide content reduce monotonously from the maximum content point to the outermost shell.

The silver iodide content at the maximum content point is preferably 15 to 45 mole %, and more preferably 25 to 40 mole %.

The silver iodide content in the outermost shell is preferably not more than 6 mole %. and more preferably 0 to 4 mole %.

The different embodiment of the invention is the silver bromoiodide grains comprising the core and the outermost shell in viewing from the direction vertical to the broadest plane, wherein the silver iodide content of the core is preferably I3 to 20 mole %; the core accounts preferably for 30 to 60% by volume of the whole grain and the silver iodide content of the outmost shell is preferably not more than 6 mole %, and more preferably 0 to 4 mole %. The core may further have therein a phase of a different composition.

The silver halide emulsion of the invention can be prepared preferably by the method in which a high silver iodide content phase is provided on a monodispersed seed grain, and more preferably by the method in which there is involved a process for growing a monodispersed spherical twinned seed emulsion, as described in Japanese Patent O.P.I. Publication No. 6643/1986, by adding a water-soluble silver salt solution and a water-soluble halide solution in the presence of a protective colloid.

The above method comprises the steps of:

(a) a process for forming a nuclear grain having a silver iodide content of 0 to 5 mole % while maintaining pBr of a mother liquid at 2.0 to −0.7 for more than ½ of the time necessary for forming the nuclear grains:

(b) a process for forming a monodispersed seed grain of a spherical twinned crystal by ripening the nuclear grains in the presence of a silver halide solvent of $10^{-5}$ to 2.0 moles per mole of silver halide, and (c) a process for growing the seed grains by adding a water-soluble silver salt solution, a water-soluble halide solution and/or fine silver halide grains.

Two or more twinned planes may be or may not be parallel to each other.

The grains may comprise {111} planes, {100} planes or a combination thereof.

In the process for forming the nuclear grains, pBr is maintained at 2.0 to −0.7, preferably 1.5 to −0.7 for more than ½ of the time necessary for forming the nuclear grains.

The nuclear grains may be either monodispersed or polydispersed, wherein polydispersion is defined by the grain size distinction of not less than 25%. The nuclear grains of the invention contain the twinned grains accounting for at least 50%, preferably 70% or more, and more preferably 90% or more of the whole nuclear grains.

Substantially monodispersed spherical seed grains are prepared by ripening the nuclear grains in the presence of a silver halide solvent of $10^{-5}$ to 2.0 moles per mole of silver halide. The substantially monodispersed grains are defined by the grains having a grain size distribution of less than 25%.

The substantially spherical grains are defined by the grains which are round to such extent that the {111} or {100} planes are hardly recognizable by observation through an electron microscope and have a ratio L/l of 1.0 to 2.0, preferably 1.0 to 1.5, wherein L and l are the maximum and minimum grain diameters, respectively.

The spherical grains account for 60% or more, preferably 80% or more, and more preferably almost all by volume of the whole seed grains.

The examples of the silver halide solvent used in the invention are (a) the organic thioethers described in U.S. Pat. Nos. 3,271,157, 3,531,289 and 3,574,628. Japanese Patent O.P.I. Publication Nos. 1019/1979 and 158917/1979, and Japanese Patent Examined Publication No. 30571/1983; (b) the thiourea derivatives described in Japanese Patent O.P.I. Publication Nos. 82408/1978, 29829/1980 and 77737/1980; (c) the silver halide solvent having a thiocarbonyl group sandwiched between an oxygen atom or sulfur atom and a nitrogen atom described in Japanese Patent O.P.I. Publication No. 144319/1978; (d) the imidazoles described in Japanese Patent O.P.I. Publication No. 100717/1979; (e) sulfites; (f) thiocyanates; (g) ammonia; (h) the hydroxyalkyl-substituted ethylenediamines described in Japanese Patent O.P.I. Publication No. 196228/1982; (i) the substituted mercaptotetrazoles described in Japanese Patent O.P.I. Publication Nos. 202531/1982; (j) water-soluble bromides; and (k) the benzimidazole derivatives described in Japanese Patent O.P.I. Publication No. 54333/1983.

The following are the examples of the silver halide solvents enumerated in the above (a) through (k).

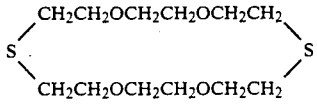

(a)

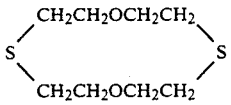

-continued $HOCH_2CH_2SCH_2CH_2SCH_2CH_2OH$ $CH_2NHCOCH_2CH_2COOH$
|
$CH_2SCH_2CH_2SC_2H_5$ $CH_2NHCOC_3H_7$
|
$CH_2SCH_2CH_2SCH_2CH_2COOH$

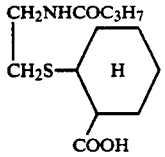

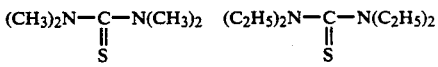

(b)

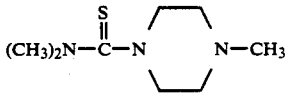

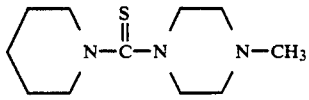

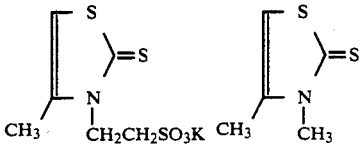

(c)

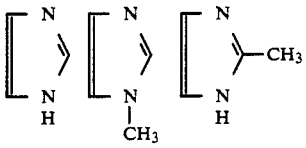

(d)

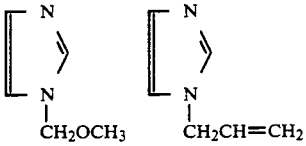

$K_2SO_3$, $Ka_2SO_3$ (e)

$NH_4SCN$, KSCN (f)

$NH_3$ (g)

$(HOCH_2CH_2)_2NHC_2CH_2N(CH_2CH_2OH)_2$ (h)

$(CH_3\underset{\underset{OH}{|}}{CH}CH_2)_2NCH_2CH_2N(CH_2\underset{\underset{OH}{|}}{CH}CH_3)_2$ $(C_2H_5)_2NCH_2CH_2N(CH_2CH_2OH)_2$ $(C_2H_5\underset{\underset{OH}{|}}{CH}CH_2)_2NCH_2CH_2N(CH_2\underset{\underset{OH}{|}}{CH}C_2H_5)_2$

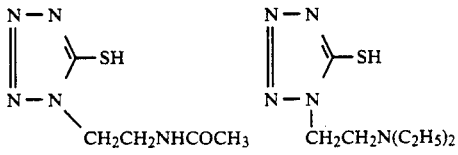

(i)

-continued

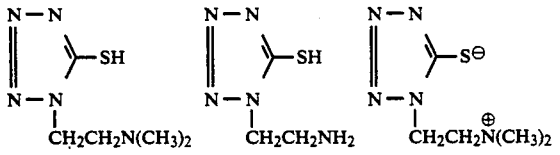

NaBr, $NH_4Br$, KBr (j)

(k)

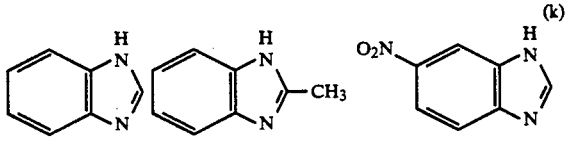

These solvents may be used in combination. Preferred solvents are thioethers, thiocyanates, thioureas, ammonia and bromides. More preferred is the combination of ammonia and bromides.

pH is 3 to 13, preferably 6 to 12, and the temperature is 30 to 70° C., preferably, 35 to 50° C.

In one example of the preferred embodiment of the invention, ammonia of 0.4 to 1.0 mole/liter and potassium bromide of 0.03 to 0.5 mole/liter are combinedly used in ripening at pH 10.8 to 11.2 and the temperature of 35 to 45° C. for 30 seconds to 10 minutes, whereby the seed grains are prepared.

A water-soluble silver salt may be added for controlling of the ripening during the preparation of the seed grains.

The methods for growing the seed grains are disclosed in Japanese Patent O.P.I. Publication Nos. 39027/1976, 142329/1980, 113928/1983, 48521/1979 and 49938/1983, in which a water-soluble silver salt solution and a water-soluble halide solution are added by a double-jet method at the adding speed which is gradually changed so that neither new nuclear grains formation nor Ostwald ripening takes place. There is another method for growing the seed grains, in which silver halide fine grains are added, dissolved and recrystallized to thereby grow seed grains, as described in the collection of summarized reports of the annual meeting '83 of The Society of Photographic Science and Technology of Japan.

In preparation of the high silver iodide content silver halide emulsion of the invention, pAg is 5 to 11, preferably 6.0 to 9.5; the temperature is 40° to 85° C. preferably 60° to 80° C.; and pH is 1.5 to 5.8, preferably 1.8 to 3.0.

The concentration of a silver nitrate aqueous solution used in the growth of the high silver iodide-content phase in the central core of the silver halide grain of the invention is preferably not more than IN, preferably 0.3 to 0.8N.

In preparing the silver halide emulsion of the invention, the stirring condition in the preparation is an important factor. The stirring device disclosed in Japanese Patent O.P.I. publication No. 160128/1987 is preferably used, in which the nozzles for supplying the solutions are disposed in the proximity of a stirrer. The rotating speed of the stirrer is preferably 400 to 1200 rpm.

The silver halide emulsion used in the invention may be chemically sensitized in the usual manner and spectrally sensitized with sensitizing dyes to prescribed wavelength regions.

The silver halide emulsion may contain an antifoggant and a stabilizer. Gelatin is used preferably as a binder for the emulsion.

The emulsion layers and other hydrophilic colloid layers may be hardened and contain a plasticizer and a latex.

The invention is applied preferably to color light-sensitive materials such as color negative films and color reversal films.

Couplers are used in the light-sensitive layers of the color light-sensitive material.

Further, there may be used color correction effects-having colored couplers, competitive couplers, and compounds which can release by a coupling reaction with an oxidation product of a developing agent photographically useful fragments such as development accelerators, bleaching accelerators, developing agents, silver halide solvents, toning agents, hardeners, fogging agents, antifoggants, chemical sensitizers, spectral sensitizers and desensitizers.

The light-sensitive material may have auxiliary layers such as a filter layer, an antihalation layer and an antiirradiation layer. These layers and/or emulsion layers may contain a dye which is removed or bleached while the layers are processed in a developer solution.

The light-sensitive material may contain a formalin scavenger, a brightening agent, a matting agent, a lubricant, an image stabilizer, a surfactant, an antifogging agent, a development accelerator, a development retarder and a bleaching accelerator.

The examples of the supports are polyethylene-laminated paper, polyethylene terephthalate film, baryta paper or cellulose triacetate film.

The light-sensitive material is subjected to conventional processing after exposure.

EXAMPLES

The invention is detailed by the following examples.

EXAMPLE 1

Preparation of a spherical seed emulsion

A monidispersed spherical seed emulsion was prepared in accordance with the method described in Japanese Patent O.P.I. Publication No. 6643/1986.

| | |
|---|---|
| Solution A1 | |
| Osein gelatin | 150 g |
| Potassium bromide | 53.1 g |
| Potassium iodide | 24 g |
| Water to make | 7.2 liters |
| Solution B1 | |
| Silver nitrate | 1.5 kg |
| Water to make | 6 liters |
| Solution C1 | |
| Potassium bromide | 1327 g |
| 1-Phenyl-5-mercaptotetrazole (methanol solution) | 0.3 g |
| Water to make | 3 liters |
| Solution D1 | |
| Ammonia water (28%) | 705 ml |

To Solution A1 which was vigorously stirred at 40° C. were added in 30 seconds Solutions B1 and C1 by a double jet method for nucleus formation, while maintaining pBr at 1.09 to 1.15.

One minute and 30 seconds later, Solution D1 was added in 20 seconds, and the emulsion was ripened for 5 minutes, wherein the concentrations of KBr and ammonia were 0.07 mole/liter and 0.63 mole/liter, respectively.

After that, pH was adjusted to 6.0, and the emulsion was immediately desalted and washed. Observation through an electron microscope revealed that this seed emulsion comprised the monodispersed spherical grains having an average grain diameter of 0.36 μm and a grain size distribution of 18%.

EXAMPLE 2

Preparation of an emulsion of the invention

The emulsion of the invention having an average silver iodide content of 7.9% was prepared in accordance with the following manner:

| | |
|---|---|
| Solution A2 | |
| Osein gelatin | 74.1 g |
| Seed emulsion in Example 1 | an amount equivalent to 0.372 mole |
| Water to make | 4 liters |
| Solution B2-1 | |
| Silver nitrate | 591 g |
| Nitric acid (1.38) | 15.7 ml |
| Water to make | 3164 ml |
| Solution C2-1 | |
| Osein gelatin | 127 g |
| Potassium bromide | 352 g |
| Potassium iodide | 86.7 g |
| Water to make | 3164 ml |
| Solution B2-2 | |
| Silver nitrate | 591 g |
| Nitric acid (1.38) | 3.8 ml |
| Water to make | 925 ml |
| Solution C2-2 | |
| Osein gelatin | 37 g |
| Potassium bromide | 381 g |
| Potassium iodide | 5.4 g |
| Water to make | 925 ml |

A device according to Japanese Patent O.P.I. Publication No. 160128/1987 was used, in which each six supply nozzles for Solutions B2 and C2 were disposed under the stirring blades.

To Solution A2 which was stirred at 1000 rpm and 75° C. were added Solutions B2-1 and C2-1 in 120 minutes and 17 seconds by a double-jet method at a flow rate gradually accelerated from 12.21 ml/min in the initial stage up to 26.03 ml/min in the final stage, and thereafter the addition was continued for 33 minutes and 11 seconds at a flow rate of 26.03 ml/min, while maintaining pAg at 8.0 and pH at 2.0 with nitric acid.

Subsequently. Solutions B2-2 and C2-2 were added in 22 minutes and 26 seconds by a double-jet method at a flow rate accelerated from 38.5 ml/min in the initial stage up to 44.0 ml/min in the final stage, while maintaining pAg and pH at 8.0 and 2.0, respectively.

After completion of the addition, pH was adjusted to 6.0, and the emulsion was desalted.

Observation through an electron microscope revealed that the grains were monodispersed and 100% twinned and that the ratio of the grains having two or more parallel twinned planes was 85% and the grain size distribution was 13%.

A (420) X-ray diffraction diagram of the above grains by a CuK α ray showed that the intercepts at the points of 0.13 and 0.15 times the maximum peak height corresponded to 1.60° and 1.5 degrees of the diffraction angle (2θ), respectively.

The average value of the grain diameter/grain thickness ratios of the grains having an even number of twinned planes was 2.8.

This emulsion is designated as Em-1.

EXAMPLE 3

The emulsion of the invention having an average silver iodide content of 8.0 mole % was prepared in accordance with the following method.

| | |
|---|---|
| Solution A3 | |
| Osein gelatin | 74.1 g |
| Seed emulsion in Example 1 | an amount equivalent to 0.372 mole |
| Water to make | 4000 ml |
| Solution B3-1 | |
| Silver nitrate | 193.7 g |
| Nitric acid (1.38) | 10.3 ml |
| Water to make | 2074 ml |
| Solution C3-1 | |
| Osein gelatin | 83 g |
| Potassium bromide | 95.0 g |
| Potassium iodide | 56.9 g |
| Water to make | 2074 ml |
| Solution B3-2 | |
| Silver nitrate | 943.1 g |
| Nitric acid (1.38) | 6.6 ml |
| Water to make | 1585 ml |
| Solution C3-2 | |
| Osein gelatin | 13.0 g |
| Potassium bromide | 115.4 g |
| Potassium iodide | 28.4 g |
| Water to make | 326 ml |
| Solution C3-3 | |
| Osein gelatin | 50.4 g |
| Potassium bromide | 519.6 g |
| Potassium iodide | 7.32 g |
| Water to make | 1259 ml |

The same device as that of Example 2 was used.

To Solution A3 which was stirred at 1000 rpm and 75° C. were added Solutions B3-1 and C3-1 in 55 minutes and 9 seconds by a double-jet method at a flow rate gradually accelerated from 24.2 ml/min in the initial stage up to 50.8 ml/min in the final stage, while maintaining pAg and pH at 8.0 and 2.0 with nitric acid, respectively.

Next, to this solution were added Solutions B3-2 and C3-2 in 35 minutes and 3 seconds by a double-jet method at a flow rate gradually accelerated from 7.98 ml/min in the initial stage up to 10.62 ml/min in the final stage, during which pAg and pH were maintained at 8.0 and 2.0, respectively.

Subsequently, to this solution were added Solutions B3-3 and C3-3 in 24 minutes and 19 seconds by a double-jet method at the flow rates of 39.09 ml/min in the initial stage and 69.1 ml/min in the final stage, during which pAg and pH were maintained 8.0 and 2.0, respectively. After completion of the addition, pH was adjusted to 6.0, and the emulsion was desalted and washed in the usual manner.

Observation through an electron microscope revealed that the grains were monodispersed and 100% twinned and that the ratio of the grains having two or more parallel twinned planes was 82% and the grain size distribution was 14%.

The average value of the grain diameter/grain thickness ratios of the grains having two or more parallel twinned planes was 1.9.

A (420) X-ray diffraction diagram of the above grains by a CuK α ray showed that the intercepts at the points of 0.13 and 0.15 times the maximum peak height corresponded to 2.15 and 2.05 degrees of the diffraction angle (2θ), respectively.

This emulsion is designated as Em-2.

EXAMPLE 4

Preparation of an emulsion of the invention

Emulsion-3 of the invention having an average silver iodide content of 10.1 % was prepared in the same manner as in Examples 2 and 3, using the seed emulsion of Example 1.

This emulsion consisted of monodispersed grains which were 100% twinned. The ratio of the grains having two or more parallel twinned planes was 78% and the grain size distribution was 14%.

A (420) X-ray diffraction diagram of the grains by a CuK α ray showed that the diagram had three peaks and the intercepts at the points of 0.13 and 0.15 times the maximum peak height corresponded to 2.38 and 2.28 degrees, respectively.

COMPARATIVE EXAMPLE 1

Comparative emulsions Em-A and Em-B were prepared in the same manner as in Examples 2 and 3.

Both Em-A and Em-B were monodispersed and consisted of 100% twinned grains having the grain size distribution of 13%.

The (420) X-ray diffraction analysis of these comparative emulsions showed the following:

Em-A: Diffraction diagram consists of two peaks; the intercepts at the points of 0.13 and 0.15 times the maximum peak height correspond to 1.00 and 0.93 degrees, respectively.

Em-B: Diffraction diagram consists of two peaks; the intercepts at the points of 0.13 and 0.15 times the maximum peak height correspond to 1.73 and 1.13 degrees, respectively.

The volume ratios and AgI contents of the seeds, cores, intermediate shells and outermost shells of Emulsions Em-1 to Em-3 of the invention and Em-A and Em-B of the comparison are shown in Table 1.

TABLE 1

| | Seed | | Core | | Intermediate shell | | Outermost shell | | Average AgI |
|---|---|---|---|---|---|---|---|---|---|
| Em No. | Vol % | AgI % | Vol % | AgI % | Vol % | AgI % | Vol % | AgI % | Content (%) |
| Em-1 | 5 | 1.4 | 49 | 15 | — | — | 46 | 1 | 7.9 |
| Em-2 | 5 | 1.4 | 16 | 30 | 16 | 15 | 62 | 1 | 8.0 |
| Em-3 | 5 | 1.4 | 17 | 35 | 17 | 20 | 61 | 1 | 10.1 |
| Em-A | 5 | 1.4 | 17 | 30 | — | — | 78 | 1 | 6.0 |
| Em-B | 5 | 1.4 | 30 | 38 | — | — | 65 | 1 | 12.1 |

EXAMPLE 5

Each of Em-1 to Em-3 of the invention and Em-A and Em-B of the comparison was chemically sensitized with sodium thiosulfate, chloroauric acid and ammonium thiocyanate and spectrally sensitized with sensitizing dyes S-1 to S-7, and further stabilizer Stab-1 and antifoggant AF-1 were added thereto, whereby the multilayer color light-sensitive materials samples 1 to 5 were prepared, wherein the added amounts of the components are indicated in grams per $m^2$ unless otherwise stated. Amounts of the silver halide and colloidal silver are in silver equivalent. The sensitizing dyes are in molar amounts per mole of silver.

On a triacetyl cellulose film support were formed in order from the support side the layers having the following compositions to prepare a Comparative Sample 1.

| | |
|---|---|
| Layer 1: Antihalation layer | |
| Black colloidal silver | 0.2 |
| Gelatin | 0.4 |
| UV absorber UV-I | 0.3 |
| High-boiling organic solvent Oil-1 | 0.3 |
| Layer 2: Intermediate layer | |
| Gelatin | 1.0 |
| Layer 3: First red-sensitive emulsion layer | |
| Silver iodobromide emulsion (AgI: 7 mole %, octahedron, 0.3 μm) | 0.6 |
| Gelatin | 1.2 |
| Sensitizing dye S-1 | $8 \times 10^{-4}$ |
| Sensitizing dye S-2 | $5 \times 10^{-4}$ |
| Sensitizing dye S-3 | $3 \times 10^{-5}$ |
| Coupler C-1 | 0.10 |
| Coupler C-3 | 0.25 |
| Colored coupler CC-1 | 0.04 |
| DIR coupler D-2 | 0.05 |
| High-boiling organic solvent Oil-1 | 0.45 |
| Layer 4: Second red-sensitive emulsion layer | |
| Silver iodobromide emulsion (AgI: 8 mole %, octahedron, 0.7 μm) | 1.0 |
| Gelatin | 1.3 |
| Sensitizing dye S-1 | $3 \times 10^{-4}$ |
| Sensitizing dye S-2 | $2 \times 10^{-4}$ |
| Sensitizing dye S-3 | $2 \times 10^{-5}$ |
| Coupler C-1 | 0.10 |
| Coupler C-3 | 0.30 |
| Colored Coupler CC-1 | 0.03 |
| DIR Coupler D-2 | 0.07 |
| High-boiling organic solvent Oil-1 | 0.50 |
| Layer 5: Third red-sensitive emulsion layer | |
| Silver iodobromide emulsion Em-A | 1.6 |
| Gelatin | 1.6 |
| Sensitizing dye S-1 | $1 \times 10^{-4}$ |
| Sensitizing dye S-2 | $1 \times 10^{-4}$ |
| Sensitizing dye S-3 | $1 \times 10^{-5}$ |
| Coupler C-1 | 0.20 |
| Coupler C-2 | 0.10 |
| Colored coupler CC-1 | 0.02 |
| DIR coupler D-2 | 0.05 |
| High-boiling organic solvent Oil-1 | 0.40 |
| Layer 6: Intermediate layer | |
| Gelatin | 0.80 |
| Additive SC-1 | 0.03 |
| Additive SC-2 | 0.02 |
| High-boiling organic solvent Oil-2 | 0.05 |
| Layer 7: First green-sensitive emulsion layer | |
| Silver iodobromide emulsion (AgI: 7 mole %, octahetron, 0.3 μm) | 0.4 |
| Gelatin | 0.8 |
| Sensitizing dye S-4 | $6 \times 10^{-4}$ |
| Sensitizing dye S-5 | $1 \times 10^{-4}$ |
| Sensitizing dye S-6 | $1 \times 10^{-4}$ |
| Coupler M-1 | 0.05 |
| Coupler M-3 | 0.25 |
| Colored coupler CM-1 | 0.04 |
| DIR coupler D-1 | 0.06 |
| High-boiling organic solvent Oil-2 | 0.40 |
| Layer 8: Second green-sensitive emulsion layer | |
| Silver iodobromide emulsion (AgI: 8 mole %, octahedron, 0.7 μm) | 0.8 |
| Gelatin | 1.1 |
| Sensitizing dye S-4 | $3 \times 10^{-4}$ |
| Sensitizing dye S-5 | $5 \times 10^{-5}$ |
| Sensitizing dye S-6 | $5 \times 10^{-5}$ |
| Coupler M-1 | 0.05 |

-continued

| | |
|---|---|
| Coupler M-3 | 0.20 |
| Colored coupler CM-1 | 0.03 |
| DIR Couler D-1 | 0.05 |
| High-boiling organic solvent Oil-2 | 0.30 |
| Layer 9: Third green-sensitive emulsion layer | |
| Silver iodobromide emulsion Em-A | 1.2 |
| Gelatin | 1.1 |
| Sensitizing dye S-4 | $2 \times 10^{-4}$ |
| Sensitizing dye S-5 | $5 \times 10^{-4}$ |
| Sensitizing dye S-6 | $5 \times 10^{-4}$ |
| Coupler M-2 | 0.05 |
| Coupler M-3 | 0.10 |
| Colored coupler CM-1 | 0.02 |
| DIR coupler D-1 | 0.02 |
| High-boiling organic solvent Oil-2 | 0.30 |
| Layer 10: Yellow filter layer | |
| Yellow colloidal silver | 0.05 |
| Gelatin | 1.0 |
| Additive SC-1 | 0.03 |
| Additive SC-2 | 0.02 |
| High-boiling organic solvent Oil-2 | 0.05 |
| Layer 11: First blue-sensitive emulsion layer | |
| Silver iodobromide emulsion (AgI: 7 mole %, octahedron, 0.7 μm) | 0.20 |
| Gelatin | 1.30 |
| Sensitizing dye S-7 | $1 \times 10^{-3}$ |
| Coupler Y-1 | 0.80 |
| DIR coupler D-2 | 0.10 |
| High-boiling organic solvent | 0.28 |
| Layer 12: Second blue-sensitive emulsion layer | |
| Silver iodobromide emulsion (AgI: 8 mole %, octahedron, 0.7 μm) | 0.50 |
| Gelatin | 0.50 |
| Sensitizing dye S-7 | $5 \times 10^{-4}$ |
| Coupler Y-1 | 0.60 |
| DIR couper D-2 | 0.08 |
| High-boiling organic solvent Oil-2 | 0.25 |
| Layer 13: Third blue-sensitive emulsin layer | |
| Silver iodobromide emulsion Em-A | 0.70 |
| Gelatin | 0.70 |
| Sensitizing dye S-7 | $2 \times 10^{-4}$ |
| Coupler Y-1 | 0.20 |

-continued

| | |
|---|---|
| DIR coupler D-2 | 0.01 |
| High-boiling organic solvent Oil-2 | 0.07 |
| Layer 14: First protective layer | |
| Silver iodobromide (AgI: 1 mole %, 0.08 μm) | 0.3 |
| Gelatin | 1.0 |
| UV absorber UV-1 | 0.1 |
| UV absorver UV-2 | 0.1 |
| Formalin scavenger HS-1 | 0.5 |
| Formalin scavenger HS-2 | 0.2 |
| High-boiling organic solvent Oil-1 | 0.1 |
| High-boiling organic solvent Oil-3 | 0.1 |
| Layer 15: Second protective layer | |
| Gelatin | 0.7 |
| Alkali-soluble matting agent (average particle size: 2 μm) | 0.12 |
| Polymethyl methacrylate (average particle size: 3 μm) | 0.02 |
| Lubricant WAX-1 | 0.004 |
| Static control agent Su-1 | 0.004 |

In addition to the above components, to each layer were added coating aid Su-2, dispersion aids Su-2 and Su-3, hardeners H-1 and H-2, stabilizer Stab-1, antifoggants AF-1 and Af-2 and anticeptic agent DI-1.

Comparative Sample 2 and inventive Samples 3 to 5 were prepared in the same manner as in Comparative Sample 1 except that the silver halide emulsions of Layers 5, 9 and 13 were changed as shown in Table 2.

TABLE 2

| Sample No. | Layer 5 AgX emulsion | Layer 9 AgX emulsion | Layer 13 AgX emulsion |
|---|---|---|---|
| 1 (Comparative) | Em-A | Em-A | Em-A |
| 2 (Comparative) | Em-B | Em-B | Em-B |
| 3 (Invention) | Em-1 | Em-1 | Em-1 |
| 4 (Invention) | Em-2 | Em-2 | Em-2 |
| 5 (Invention) | Em-3 | Em-3 | Em-3 |

S-1

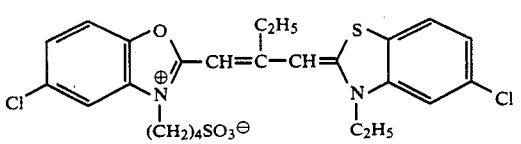

S-2

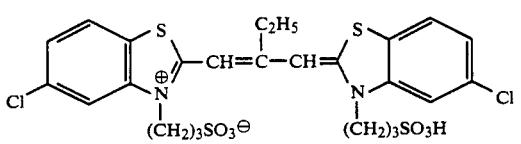

S-3

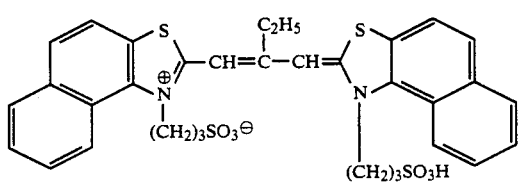

S-4

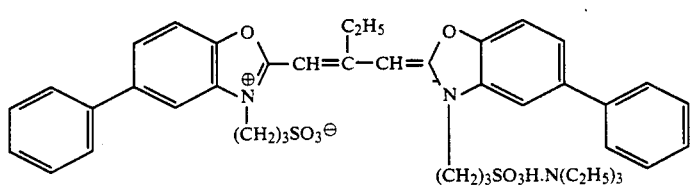

-continued
S-5
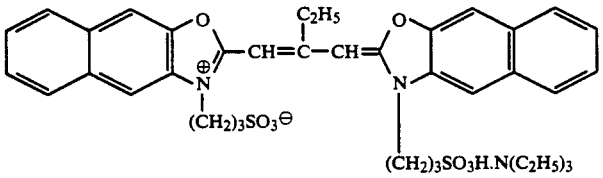
S-6
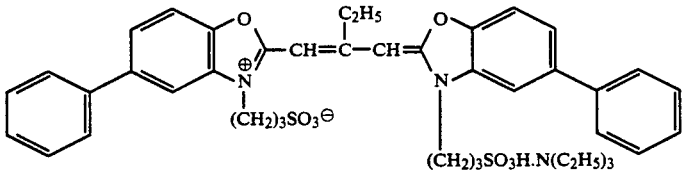
S-7
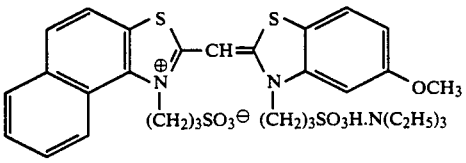
C-1
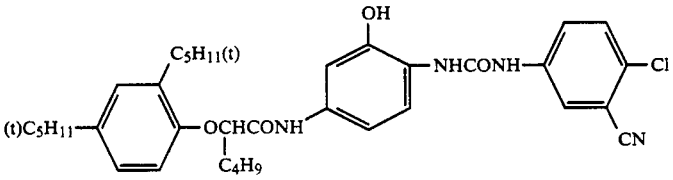
C-2
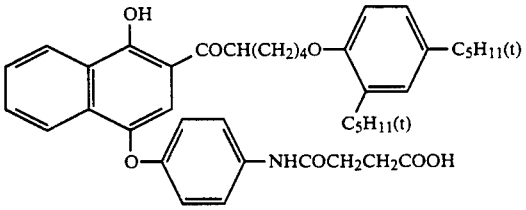
C-3
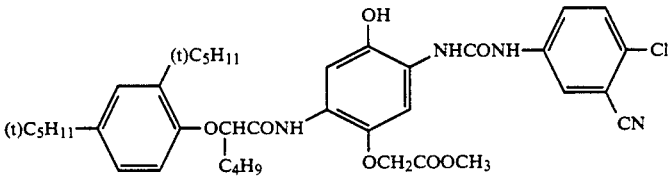
Y-1
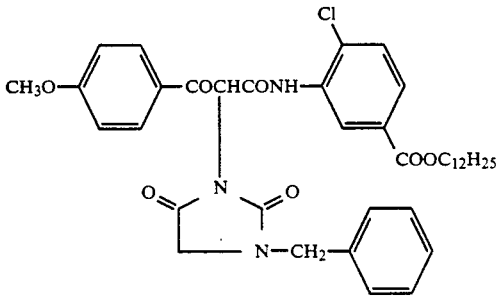

-continued
M-1
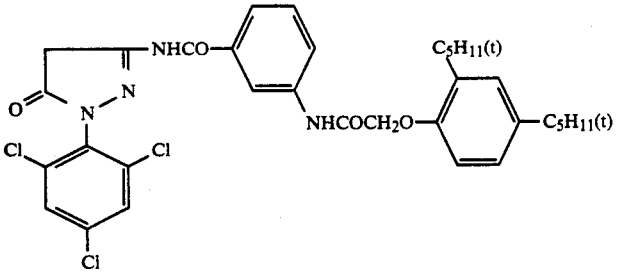
M-2
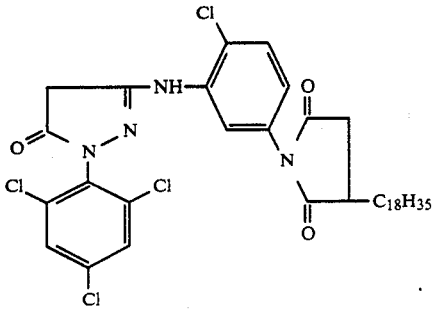
M-3
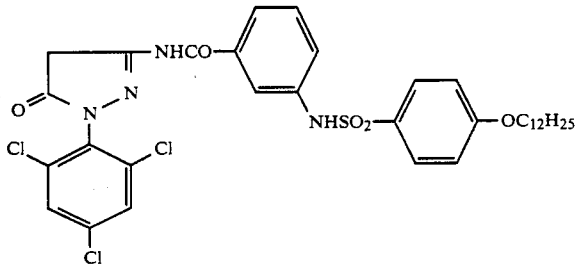
CM-1
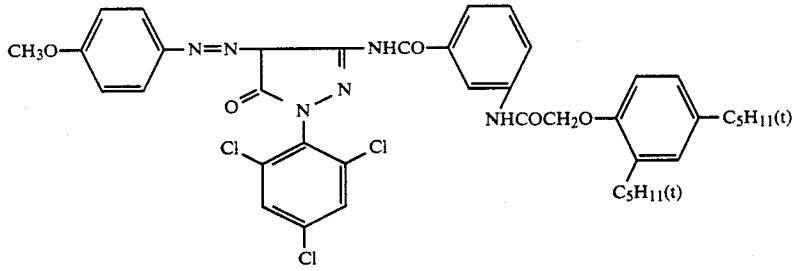
CC-1
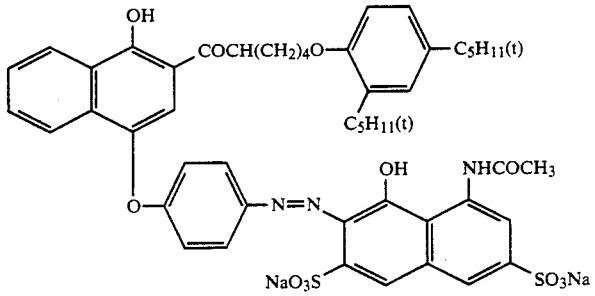

-continued
D-1
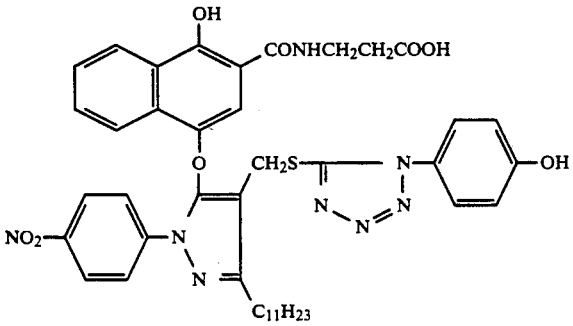
D-2
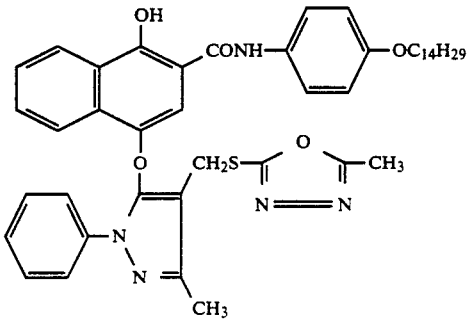
UV-1
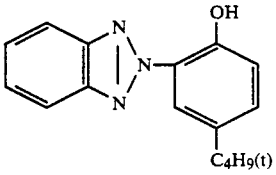
UV-2
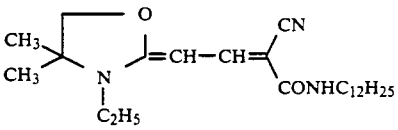
HS-1
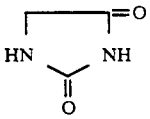
HS-2
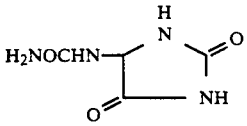
H-1
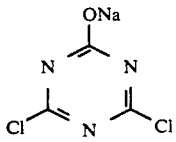
H-2
$(CH_2{=}CHSO_2CH_2)_2O$
Su-1
$NaO_3S{-}CH(COOCH_2(CF_2CF_2)_3H)CH_2COOCH_2(CF_2CF_2)_3H$
Su-2
$NaO_3S{-}CH(COOC_8H_{17})CH_2COOC_8H_{17}$ -continued
Su-3
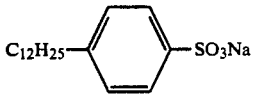
SC-1
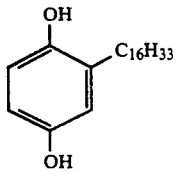
SC-2
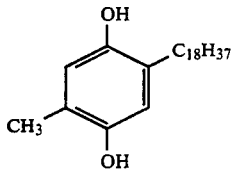
WAX-1
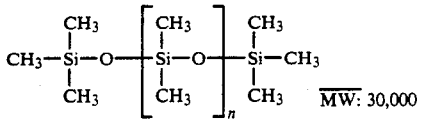
Oil-1
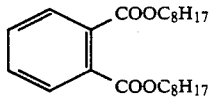
Oil-3
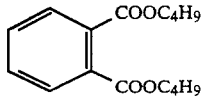
Oil-3
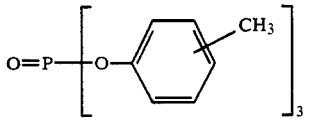
Stab-1
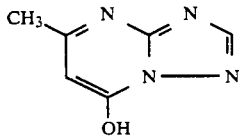
AF-1
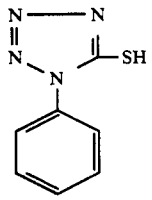
AF-2
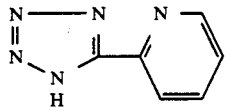
DI-1
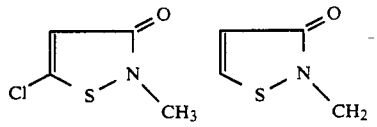

Samples 1 to 5 were each exposed through an optical wedge to white, blue, green and red lights, and then processed in the following steps:

| Processing steps (at 38° C.) | |
|---|---|
| Color developing | 3 min. & 15 sec. |
| Bleaching | 6 min. & 30 sec. |
| Washing | 3 min. & 15 sec. |
| Fixing | 6 min. & 30 sec. |
| Stabilizing | 1 min. & 30 sec. |
| Drying | |

The compositions of the processing solutions used in the above steps are as follows:

| | |
|---|---|
| Color developer | |
| 4-Amino-3-methyl-N-ethyl-N-β-hydroxyethyl-aniline sulfate | 4.75 g |
| Sodium sulfite anhydrous | 4.25 g |
| Hydroxylamine ½ sulfate | 2.0 g |
| Potassium carbonate anhydrous | 37.5 g |
| Sodium bromide | 1.3 g |
| Trisodium nitrilotriacetate, monohydrate | 2.5 g |
| Potassium hydroxide | 1.0 g |
| Water to make 1 liter (pH = 10.1) | |
| Bleacher | |
| Ferric-ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |
| Water to make 1 liter | |
| Adjust pH to 6.0 with ammonia water. | |
| Fixer | |
| Ammonium thiosulfate | 175.0 g |
| Ammonium sulfite anhydrous | 8.5 g |
| Sodium metabisulfite | 2.3 g |
| Water to make 1 liter | |
| Adjust pH to 6.0 with acetic acid. | |
| Stabilizer | |
| Formalin (37% solution) | 1.5 ml |
| Koniducks (product of KONICA Corporation) | 7.5 ml |
| Water to make 1 liter | |

The interimage effect in the toe of the characteristic curve of each processed sample was expressed by the ratios $\gamma_B/\gamma_{BN}$, $\gamma_G/\gamma_{GN}$ and $\gamma_R/\gamma_{RN}$ of the gradations by light source in the densities of fog +0.2 and fog +0.6, wherein $\gamma_B$, $\gamma_G$ and $\gamma_R$ are the gamma values obtained by exposing the light-sensitive material to blue, green and red lights and measuring the densities thereof with blue, green and red lights, respectively; and $\gamma_{BN}$, $\gamma_{GN}$ and $\gamma_{RN}$ are the gamma values obtained by exposing the same to white light and measuring the densities thereof with blue, green and red lights, respectively. The larger the ratios, the larger the interimage effect.

The linearities of the gradation were expressed by the ratios $\gamma_B/\gamma_{BH}$, $\gamma_G/\gamma_{GH}$ and $\gamma_R/\gamma_{RH}$, wherein $\gamma_{BH}$, $\gamma_{GH}$ and $\gamma_{RH}$ are the gamma values obtained by exposing the light-sensitive material to blue, green and red lights and measuring the densities of fog +0.6 and fog +1.0 with glue, green and red lights. The closer to 1 the ratio, the better the linearity.

The results are shown in Table 3.

TABLE 3

| | Interimage effect | | | Linearity of gradation | | |
|---|---|---|---|---|---|---|
| Sample No. | $\gamma_B/\gamma_{BN}$ | $\gamma_G/\gamma_{GN}$ | $\gamma_R/\gamma_{RN}$ | $\gamma_B/\gamma_{BH}$ | $\gamma_G/\gamma_{GH}$ | $\gamma_R/\gamma_{RH}$ |
| 1 (Comparative) | 1.10 | 1.08 | 1.12 | 1.21 | 1.18 | 1.18 |
| 2 (Comparative) | 1.12 | 1.10 | 1.13 | 1.18 | 1.15 | 1.14 |
| 3 (Invention) | 1.21 | 1.23 | 1.22 | 1.07 | 1.06 | 1.06 |
| 4 (Invention) | 1.24 | 1.25 | 1.25 | 1.04 | 1.03 | 1.03 |
| 5 (Invention) | 1.28 | 1.28 | 1.28 | 1.02 | 1.02 | 1.02 |

As is apparent from Table 3, Samples 3 to 5 of the invention have remarkably improved interimage effect and gradation linearity.

Further, Sample No.4 containing Em-2 of which X-ray diffraction diagram has a single peak and the broader intercept at the point of 0.13 times the maximum peak height is more excellent than Sample No. 3 containing Em-1 of which X-ray diffraction diagram has two peaks and the narrower intercept.

Sample No. 5 (Em-3) of which (420) X-ray diffraction diagram had three peaks was found still more effective than Sample No.4 (Em-2).

In the comparative Samples No. 1 and 2, there was observed an increase in the blue density (color turbidity) in the characteristic curve in exposure to green light, whereas in Samples No.3 to 5 of the invention, no color turbidity was observed.

EXAMPLE 6

The color light-sensitive material samples prepared in Example 5 were subjected to stability test to fluctuation of a processing solution composition. The samples exposed in the same manner as in Example 5 were subjected to the following running processing.

| Processing steps | Processing time |
|---|---|
| Color developing (single bath) at 38° C. | 3 min. & 15 sec. |
| Bleaching (single bath) at 38° C. | 45 sec. |
| Fixing (single bath) at 38° C. | 1 min. & 30 sec. |
| Stabilizing (3-bath cascade) at 38° C. | 1 min. |
| Drying at 40° C. to 80° C. | 1 min. |

The compositions of the solutions used are as follows:

| | |
|---|---|
| Color developer | |
| Potassium carbonate | 30 g |
| Sodium hydrogencarbonate | 2.5 g |
| Potassium sulfite | 4.0 g |
| Sodium bromide | 0.6 g |
| Potassium iodide | 1.2 mg |
| Hydroxylamine sulfate | 2.5 g |
| Sodium chloride | 0.6 g |
| Diethylenetriaminepentaacetic acid | 1.0 g |
| 4-Amino-3-methyl-N-ethyl-N-β-hydroxyethyl-aniline sulfate | 4.8 g |
| Potassium hydroxide | 1.2 g |
| Water to make | 1 liter |
| Adjust pH to 10.06 with potassium hydroxide or 50% sulfuric acid. | |
| Bleacher | |
| Ferric-ammonium 1,3-propylenediamine-pentaacetate | 0.3 mole |
| 1,3-Propylenediaminepentaacetic acid | 5 g |
| Ammonium bromide | 100 g |
| Glacial acetic acid | 30 ml |
| Ammonium nitrate | 50 g |
| Water to make | 1 liter |
| Adjust pH to 4.5 with ammonia water or glacial acetic acid. | |
| Fixer | |
| Ammonium thiosulfate | 120 g |
| Ammonium thiocyanate | 2.0 moles |

-continued

| | |
|---|---|
| Ammonium sulfite | 5 g |
| Disodium ethylenediaminetetraacetate | 0.5 g |
| Sodium carbonate | 10 g |
| The above bleaching solution | 100 ml |
| Water to make | 1 liter |
| Adjust pH to 7.0 with acetic acid or ammonia water. | |
| Stabilizer | |
| Formaldehyde (35% solution) | 0.8 ml |
| 5-Chloro-2-methyl-4-isothiazolin-3-one | 0.05 g |
| *Emulgen 810 | 1 ml |
| Formaldehyde-sodium bisulfite adduct | 2 g |
| Hexamethylenetetramine | 0.1 g |
| Water to make | 1 liter |
| Adjust pH to 7.0 with ammonia water or sulfuric acid. | |

*Emulgen 810

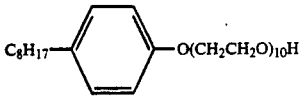

The compositions of the replenisher solutions used are as follows:

| | |
|---|---|
| Color developer replenisher | |
| Potassium carbonate | 40 g |
| Sodium hydrogencarbonate | 3 g |
| Potassium sulfite | 7 g |
| Hydroxylamine sulfate | 3.1 g |
| 4-Amino-3-methyl-N-ethyl-N-β-hydroxyethyl-aniline sulfate | 6.0 g |
| Potassium hydroxide | 2 g |
| Diethylenetriaminepentaacetic acid | 1.0 g |
| Water to make 1 liter | |
| Adjust pH to 10.12 with potassium hydroxide or sulfuric acid. | |
| Bleacher replenisher | |
| Ferric-ammonium 1,3-propylenediamine-pentaacetate | 0.5 mole |
| Imidazole | 2 g |
| Ammonium bromide | 178 g |
| Glacial acetic acid | 40 ml |
| Ammonium nitrate | 50 g |
| Water to make 1 liter | |
| Adjust pH to 3.5 with ammonium water or glacial acetic acid. | |
| Fixer replenisher | |
| Ammonium thiocyanate | 2.4 moles |
| Ammonium thiosulfate | 1.0 mole |
| Sodium hydrogensulfite anhydrous | 5 g |
| Disodium ethylenediaminetetraacetate | 0.8 g |
| Sodium carbonate | 14 g |
| Water make 1 liter | |
| Adjust pH to 6.5 with ammonia water or acetic acid. | |

The stabilizer of Example 5 was used for a stabilizer replenisher.

The processing steps, time and temperature, and the replenishing amounts used in the running processing are as follows:

| Processing step | time | Temperature | Replenishing amount* |
|---|---|---|---|
| Color developing | 3 min. 15 sec. | 38° C. | 650 ml |
| Bleaching | 45 sec. | 38° C. | 140 ml |
| Fixing | 1 min. | 38° C. | 800 ml |
| Stabilizing | 60 sec. | 38° C. | 775 ml |
| Drying | 45 sec. | 40 to 70° C. | — |

*The replenishing amount is a value per square meter of the light-sensitive material.

The fixer bath was of a two-bath countercurrent system (45 seconds for two baths).

The bleacher was sprayed on the light-sensitive material.

It was confirmed that Samples 3 to 5 of the invention were more stable in a sensitivity and fog to fluctuation of the processing solution compositions than Comparative Samples 1 and 2.

What is claimed is:

1. A silver halide photographic light-sensitive material comprising a support having component layers thereon including at least one light-sensitive layer containing a silver bromoiodide emulsion, said silver bromoiodide emulsion consisting primarily of twinned silver bromoiodide grains comprising at least a core, an intermediate shell, and an outer shell, wherein, in an X-ray diffraction curve obtained by subjecting said silver bromoiodide grains to (420) X-ray diffraction with a CuKα ray, a length of an intercept drawn horizontally through said curve at a point of 0.13 times a height of a highest peak in said curve is not less than 1.5° of diffraction angle (2θ).

2. The light-sensitive material of claim 1, wherein said length is not less than 1.8 degree of a diffraction angle (2θ).

3. The light-sensitive material of claim 2, wherein said length is not less than 2.0 degree of a diffraction angle (2θ).

4. The light-sensitive material of claim 1 wherein a length of an intercept drawn horizontally through said curve at a point of 0.15 times the height of said highest peak in said curve is not less than 1.5° of diffraction angle (2θ).

5. The light-sensitive material of claim 4, wherein said length is not less than 1.8 degree of a diffraction angle (2θ).

6. The light-sensitive material of claim 5, wherein said length is not less than 2.0 degree of a diffraction angle (20θ).

7. The light-sensitive material of claim 1, wherein the X-ray diffraction diagram comprises one peak.

8. The light-sensitive material of claim 1, wherein the X-ray diffraction diagram comprises three peaks.

9. The light-sensitive material of claim 1, wherein said silver bromoiodide grains comprise two or more twinned planes.

10. The light-sensitive material of claim 9, wherein said silver bromoiodide grains have an even number of twinned planes.

11. The light-sensitive material of claim 10, wherein said silver bromoiodide grains comprise two twinned planes.

12. The light-sensitive material of claim 1, wherein said silver bromoiodide grains comprise (111) planes, (100) planes or a combination thereof.

13. The light-sensitive material of claim 12, wherein said silver bromoiodide grains comprise (111) planes.

14. The light-sensitive material of claim 1, wherein a ratio of a diameter of a circle having the same area as that of the silver bromoiodide grains projected vertically to a twinned plane to a distance between grain surfaces parallel to the twinned plane is 1 to 20.

15. The light-sensitive material of claim 14, wherein said ratio is 1.2 to 8.0.

16. The light-sensitive material of claim 15, wherein said ratio is 1.5 to 5.0.

17. The light-sensitive material of claim 1, wherein the twinned silver bromoiodide grains account for 60% or more of the number of whole grains.

18. The light-sensitive material of claim 17, wherein said twinned silver bromoiodide grains account for 80% or more.

19. The light-sensitive material of claim 18, wherein said twinned silver bromoiodide grains account for 95 to 100%.

20. The light-sensitive material of claim 17, wherein said silver bromoiodide grains having two or more twinned planes account for 50% or more by number of the whole grains.

21. The light-sensitive material of claim 20, wherein said silver bromoiodide grains account for 60% or more.

22. The light-sensitive material of claim 21, wherein said silver bromoiodide grains account for 70% or more.

23. The light-sensitive material of claim 1, wherein an average silver iodide content of said silver bromoiodide grains is 6 to 30 mol %.

24. The light-sensitive material of claim 23, wherein said average silver iodide content is 7 to 20 mol %.

25. The light-sensitive material of claim 24, wherein said average silver iodide content is 8 to 15 mol %.

26. The light-sensitive material of claim 1, wherein said core has a silver iodide content of 18 to 45 mol %.

27. The light-sensitive material of claim 26, wherein said silver iodide content is 25 to 40 mol %.

28. The light-sensitive material of claim 1, wherein said intermediate shell has a silver iodide content of 10 to 22 mol %.

29. The light-sensitive material of claim 28, wherein said silver iodide content is 12 to 20 mol %.

30. The light-sensitive material of claim 1, wherein said outermost shell has a silver iodide content of 6 mol % or less.

31. The light-sensitive material of claim 30, wherein said silver iodide content is 0 to 4 mol %.

32. The light-sensitive material of claims 26, wherein differences of said silver iodide contents between said core and said intermediate shell and between said intermediate shell and said outermost shell are 6 mol % or more.

33. The light-sensitive material of claim 32, wherein said differences are 10 mol % or more.

34. The light-sensitive material of claim 28, wherein differences of said silver iodide contents between said core and said intermediate shell and between said intermediate shell and said outermost shell are 6 mol % or more.

35. The light-sensitive material of claim 30, wherein differences of said silver iodide contents between said core and said intermediate shell and between said intermediate shell and said outermost shell are 6 mol % or more.

36. The light-sensitive material of claim 34, wherein said differences are 10 mol % or more.

37. The light-sensitive material of claim 35, wherein said differences are 10 mol % or more.

* * * * *